US007142186B2

(12) United States Patent
Lee et al.

(10) Patent No.: US 7,142,186 B2
(45) Date of Patent: Nov. 28, 2006

(54) METHOD AND APPARATUS FOR CONVERTING GRADATION DATA IN STN LCD

(75) Inventors: Jong Sik Lee, Seoul (KR); Hong Kil Kim, Hwaseong-si (KR)

(73) Assignee: Hivix Co., Ltd, Hwaseong-si (KR)

( * ) Notice: Subject to any disclaimer, the term of this patent is extended or adjusted under 35 U.S.C. 154(b) by 362 days.

(21) Appl. No.: 10/395,663

(22) Filed: Mar. 24, 2003

(65) Prior Publication Data

US 2004/0189568 A1 Sep. 30, 2004

(51) Int. Cl.
*G09G 3/36* (2006.01)
*G09G 5/10* (2006.01)

(52) U.S. Cl. ..... 345/89; 345/690

(58) Field of Classification Search ..... 345/89, 345/87, 83, 690–693, 204
See application file for complete search history.

(56) References Cited

U.S. PATENT DOCUMENTS 5,089,812 A * 2/1992 Fuse et al. ..... 345/89
5,347,294 A 9/1994 Usui
5,465,102 A 11/1995 Usui
5,598,179 A * 1/1997 Orlen et al. ..... 345/98
5,844,533 A 12/1998 Usui
6,008,786 A * 12/1999 Kimura et al. ..... 345/89
6,008,929 A * 12/1999 Akimoto et al. ..... 359/264
6,545,672 B1 * 4/2003 Goyins ..... 345/204
6,839,048 B1 * 1/2005 Park ..... 345/89

FOREIGN PATENT DOCUMENTS

JP 7-129133 5/1995
JP 2001-117074 4/2001
KR 2001-77568 8/2001
KR 2002-86101 11/2002

* cited by examiner

*Primary Examiner*—Richard Hjerpe
*Assistant Examiner*—Kevin M. Nguyen
(74) *Attorney, Agent, or Firm*—Lilling & Lilling PLLC; Bruce E. Lilling; Sean Liam Kelleher

(57) ABSTRACT

Disclosed relates to a method and an apparatus for converting gradation data for a color STN-LCD, capable of providing color moving pictures of excellent quality. The apparatus includes a storage buffer 31 for storing input data for driving the LCD, and a frame memory 32 for storing gradation data for driving the LCD panel. A data conversion unit 33 converts gradation data stored in the storage buffer 140 based on the gradation data stored in the frame memory, i.e., previous gradation data that was used for driving the LCD. The data conversion unit 33 subtracts the gradation data stored in the frame memory 32 from the input data stored in the storage buffer 31, multiplies the subtracted result by a predetermined factor to generate a correction value, and adds the correction value to the previous gradation data to generate new gradation data. The generated gradation data is stored in the frame memory 32 as new gradation data.

8 Claims, 16 Drawing Sheets

METHOD AND APPARATUS FOR CONVERTING GRADATION DATA IN STN LCD

BACKGROUND OF THE INVENTION

1. Field of the Invention

The present invention relates generally to a super twisted nematic liquid crystal display (STN LCD), and more particularly to a method and an apparatus for converting gradation data in the STN LCD, which provides color moving pictures of excellent quality.

2. Description of the Related Art

With the wide spread of multimedia services, various kinds of display apparatus for providing images and/or moving pictures have been developed. The most typical display apparatus is a cathode-ray tube (CRT), which has an important weakness that the CRT is a bulky tube. Accordingly, a liquid crystal display (LCD) and a plasma display panel (PDP) have been increasingly popularized in recent. Particularly, the LCD apparatus wins popularity in view of its thin and light properties The LCD consists primarily of two glass plates, on which transparent electrodes are formed, with some liquid crystal material filled between them. When a predetermined current is applied to the transparent electrodes, the current arranges and rotates the liquid crystal material in a specific direction so as to control the quantity of lights transmitting the liquid crystal material, thus displaying images. The LCD is made with either a passive matrix or an active matrix display grid. The active matrix LCD is also known as a thin film transistor (TFT) display. The TFT LCD having a transistor located at each pixel intersection can provide high quality images because it drives each pixel using the transistor directly. However, the TFT-LCD has shortcomings that it requires high electric power and its unit price is very high.

In the meantime, with the rapid development of Internet technology in recent years, wireless Internet services, through which a user can use the Internet by using a mobile communication terminal such as PCS (personal communication system) or cellular phone, are developed and popularized. In addition, according as the International Mobile Telecommunications-2000 (IMT-2000) has becomes commercially available, various kinds of display apparatus capable of providing color moving pictures have been adapted to the mobile communication terminal. In general, the mobile communication terminal requires a specific display device that has a small size, a low unit price and low power consumption as well. Accordingly, inexpensive simple matrix TN or STN LCD is considered to be suitable for the mobile communication terminal. Especially, the STN-LCD is the most noticeable because it has wider viewing angle and higher contrast than those of the TN-LCD and is able to display images with large capacity.

However, the STN-LCD has a long response time to input data due to the influence of cumulative response. Accordingly, in case that a fast moving picture is displayed through the STN-LCD panel, image sticking phenomenon, that an image of a previous screen does not immediately disappear but is overlapped with a subsequent image, deteriorates vividness of the moving picture. To solve this problem, there has been proposed a method of appropriately converting gradation data provided to the STN-LCD.

FIG. 1 illustrates characteristic curves showing transmissivity varied as time passes when predetermined gray-scale voltages are applied to the STN-LCD. In FIG. 1, (a), (b) and (c) represent transmissivity variation characteristics obtained when voltages corresponding to the brightest gradation state and the darkest gradation state (a), voltages corresponding to the brightest gradation state and a medium-brightness gradation state (b), and voltages corresponding to the darkest gradation state and the medium brightness gradation stale (c) are applied to the STN-LCD, respectively. Referring to FIG. 1, in ease of the waveform (a), the transmissivity varies very fast according to the variation in the applied voltages, resulting in a delay time of up to 20–30 ms, whereas, in case of the waveforms (b) and (c), the transmissivity varies considerably slow according to the variation in the applied voltages, resulting in delay time of more than 100 ms, respectively. Of course, all of STN-LCDs do not have the same response delay time with the aforementioned one but have different ones depending on the manufacturers and the product specifications. In general, all of STN-LCDs have a relatively fast response characteristic when a gray scale level of video data being displayed is sharply changed, whereas, they show a relatively slow response characteristic when the gray scale level of video data is slightly varied, thus resulting in residual images. Accordingly, it is known that the response speed of the STN-LCD can be improved if the STN-LCD is adequately over-driven to increase time-sequential variation in the gradation voltage applied to the STN-LCD.

U.S. Pat. No. 5,347,294, U.S. Pat. No. 5,465,102 and U.S. Pat. No. 5,344,533 and Japanese Patent Publication No. 1995-129133 disclose methods for improving the response speed of the STN-LCD by converting gradation data provided to an LCD panel to adequately over-drive the LCD panel.

FIG. 2 is a block diagram for explaining the basic concept of the aforementioned patents. The configuration shown in FIG. 2 includes first and second frame memories 1 and 2 for storing gradation data, and a ROM table 3 for gradation conversion. Here, the first frame memory 1 stores gradation data of a previous one frame acquired from a video signal, whereas, the second frame memory 2 stores gradation data of a current one frame obtained from the video signal. The ROM table 3 uses the gradation data output from the first and second frame memories 1 and 2 as addresses to output predetermined gradation data corresponding to the addresses. The ROM table 3 stores appropriate gradation data corresponding to variations between the previous gradation data and the current gradation data. For instance, the ROM table 3 is set to output gradation data "100" when the previous gradation data is "000" and the current gradation data is "010". In the above-described configuration, the gradation data of the previous frame obtained from the video signal is compared with the gradation data of the current frame to set the variation between the two gradation values large forcibly, so as to improve the response speed of the STN-LCD.

However, the aforementioned prior art has following problems:

1. The prior art technique generates new gradation data to be currently displayed based on the previous gradation data stored in the first frame memory 1 and the current gradation data stored in the second frame memory 2. Here, the previous gradation data stored in the first frame memory 1 is not the one that has been actually displayed through the STN-LCD previously but the original one obtained from the video signal. Accordingly, when the gradation data acquired from the video signal increases in stages as time passes, such as "000", "0101", "1011 ", "100" . . . for example, as represented by waveform (a) in FIG. 3, the new gradation data obtained through gradation conversion will be also increased in stages, as shown by waveform (b), similarly to the waveform (a). That is, waveform (b) represents an example where the ROM table 3 is set to make a new gradation value "2" larger than the current one when the difference between two gradation values stores in the first and second frame memories 1 and 2, respectively, is "2", and makes a new gradation value "1" larger than the current one when the difference is "1".

Comparing the waveforms (a) with (b), their gradation value variations with the lapse of time are similar to each other. That is, gradation value variation between the original gradation data and the newly obtained gradation data with the lapse of time is set similar to each other. This occurs mostly when the time-sequential variation in the gradation data value increases or decreases in stages. In the prior art, however, since the gradation conversion is executed based on the gradation value obtained from the video signal, not based on the gradation value that has been previously displayed through the LCD, it is insufficient to improve the response speed effectively.

2. In the configuration of the prior art shown in FIG. 2, since the gradation conversion is carried out through the ROM table 3, it is necessary to store specific gradation data in advance in the ROM table 3 corresponding to the gradation data in the first and second frame memories 1 and 2. The specific gradation data stored in the ROM table 3 is an experimental value and variable depending on manufacturers or kinds of LCD panels, which causes difficulties in designing and constructing the ROM table. Especially, to meet the consumers demand for high-quality pictures in recent years, the number of colors to be displayed through the LCD panel reaches 65,000 to 260,000. The increase in the number of colors causes many difficulties in configuring the ROM table 3, which results in considerable restrictions on the application range and design flexibility of the apparatus employing the ROM table 3.

SUMMARY OF THE INVENTION

Accordingly, an object of the present invention is to provide a method and apparatus for converting gradation data in an STN-LCD for effectively improving response characteristic of the STN-LCD without affecting images displayed thereon.

Another object of the invention is to provide an apparatus for converting gradation data in an STN-LCD, which is easily designed and manufacture, and further can cope with various design specifications of the STN-LCD.

To accomplish of the objects of the present invention, there is provided a gradation data converting method for an STN-LCD comprising the steps of: inputting gradation data for driving the STN-LCD; comparing the input gradation data with gradation data corresponding to the input data, which was previously output through the STN-LCD, to calculate a difference between tern; converting the input gradation data based on the difference; and setting the converted gradation data as new gradation data for driving the STN-LCD.

The converting step includes the steps of: multiplying the difference by a predetermined factor having a positive value larger than 1; and adding the multi plied result to the previous gradation data.

In the converting step, if the added result is larger than a maximum gradation value, the maximum gradation value is set as new gradation data, whereas, if the added result is smaller than a minimum gradation value, the minimum gradation value is set as new gradation data.

To accomplish of the objects of the present invention, there is provided a gradation data converting apparatus for an STN-LCD comprising: an input data storing means for storing gradation data that is input for driving the STN-LCD; a frame memory storing gradation data for driving the STN-LCD; and a data converting means for converting the input data based on the gradation data stored in the flame memory, and storing the converted data in the frame memory as new gradation data.

The data converting means subtracts the gradation data stored in the frame memory from the input data stored in the input data storing means, multiplies the subtracted result by a predetermined factor to generate a correction value, and adds the correction value to the previous data, to generate new gradation data.

To accomplish of the objects of the present invention, there is provided a gradation data converting apparatus for an STN-LCD comprising: a storage buffer for temporarily storing input gradation data; a frame memory for storing gradation data displayed through the LCD; a first address generator for generating a first address data for the frame memory, corresponding to a current display position; a second address generator for generating a second address data for the frame memory of the gradation data stored in the storage buffer, a gradation operating means for generating predetermined gradation data based on the gradation data stored in the storage buffer and gradation data output from the frame memory according to the second address data, and storing the generated gradation data in a second address region of the frame memory; a gradation driving data generator for generating and outputting gradation driving data for the LCD based on the gradation data stored in the frame memory; and a sequence controller for sequentially controlling time generation of the gradation driving data, performed by the gradation driving data generator, and the gradation operating process carried out by the gradation operating means.

The gradation operating means subtracts the gradation data stared in the frame memory from the gradation data stored in the storage buffer, multiplies the subtracted result by a predetermined factor to generate a correction value, and adds the correction value to previous gradation data, to generate new gradation data.

In addition, the factor is larger than 1.

Furthermore, the factor is variably set according to the subtracted result.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE INVENTION

Reference will now be made in detail to the preferred embodiments of the present invention, examples of which are illustrated in the accompanying drawings.

First, the basic concept of the present invention will be described hereinafter.

The present invention is directed to a method for converting gradation data that accomplishes a high response speed of STN-LCD by setting time-sequential variation in gradation data provided to an LCD panel very large. Completely different from the prior art, the present invention generates new gradation data to be displayed based on the gradation data that was actually displayed on the LCD panel. When gradation conversion is executed based on the gradation data that was previously displayed on the LCD panel, the following technical effects can be obtained.

Figure 1:
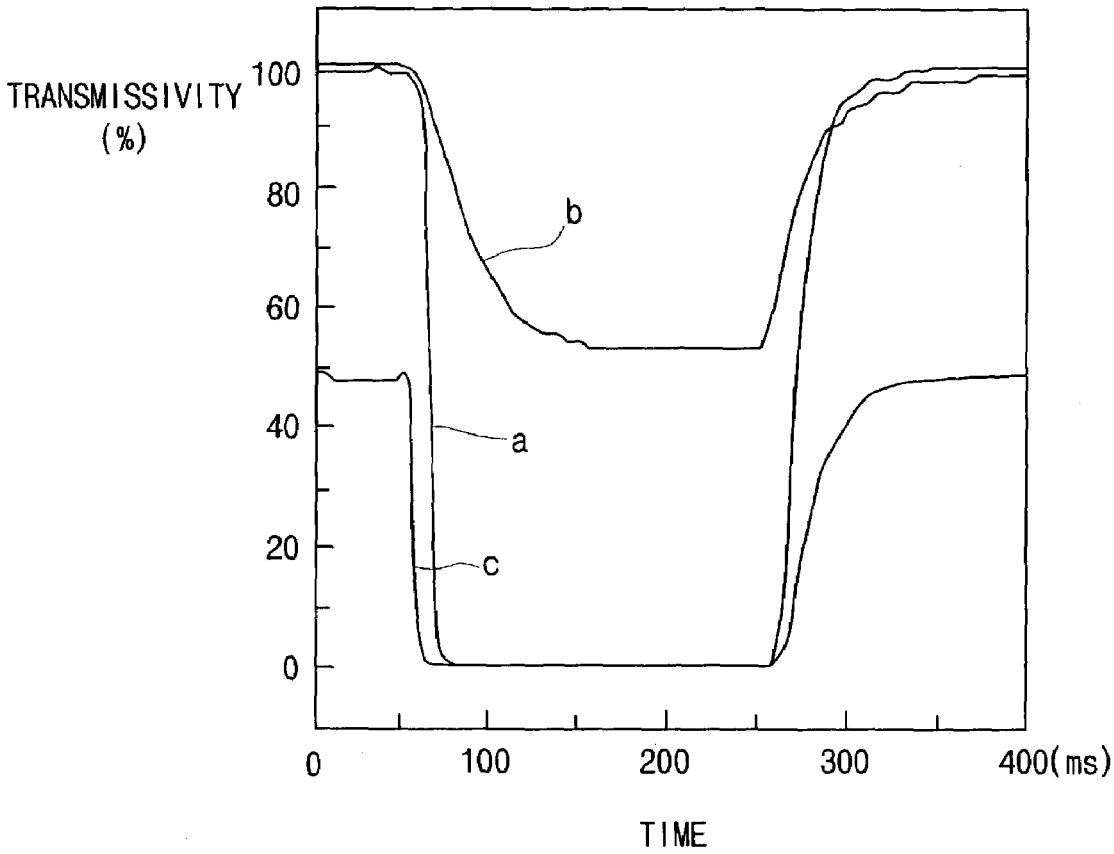
Fig. 1 PRIOR ART
FIG. 1 illustrates characteristic curves showing variations in transmissivity with the lapse of time when predetermined gradation voltages are applied to an STN-LCD.
Figure 2:
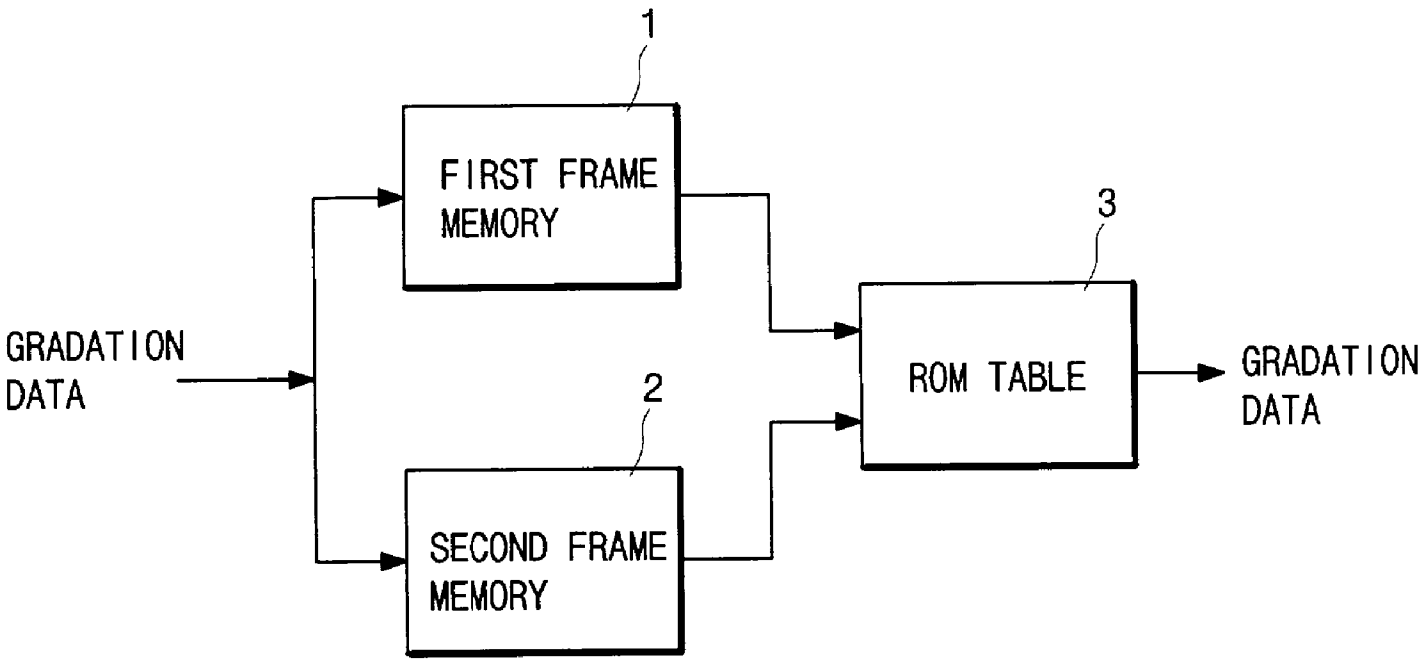
Fig. 2 PRIOR ART
FIG. 2 is a block diagram showing the basic configuration of the prior art.
Figure 3:
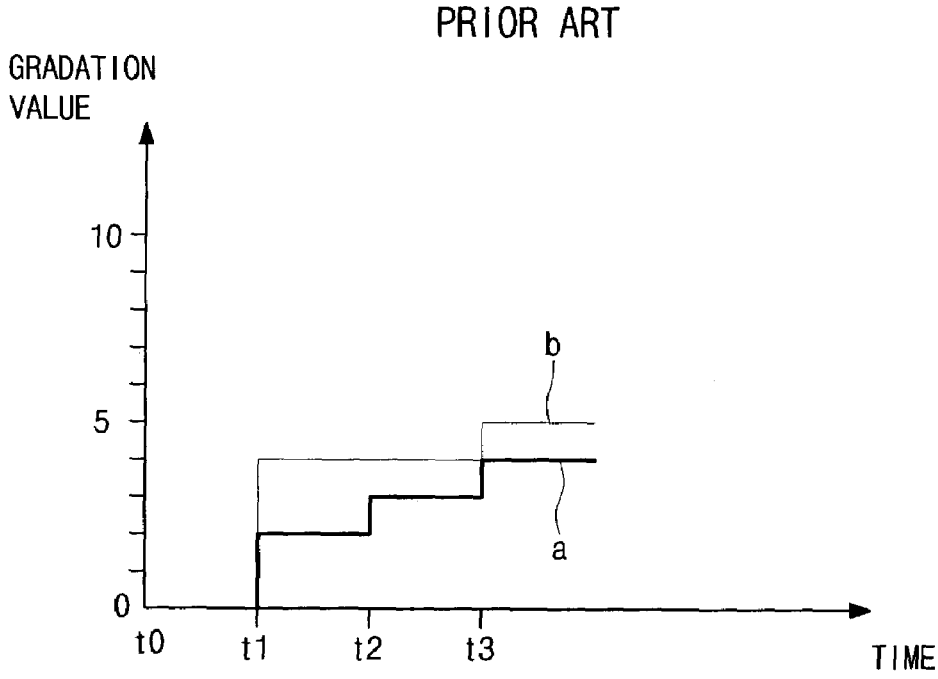
FIG. 3 is a diagram for explaining problems of the prior art.
Figure 4:
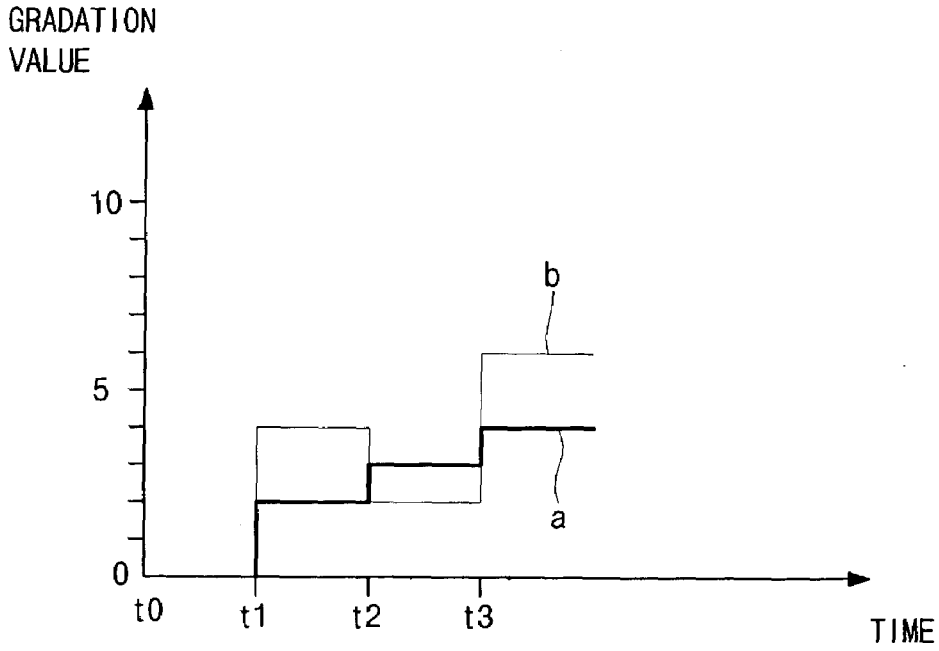
FIGS. 4, 5*a* and 5*b* are diagrams for explaining the basic concept of the present invention.

FIG. 4 is a diagram for explaining a gradation conversion process according to the present invention, which corresponds to FIG. 3 for the prior art.

In FIG. 4, a waveform (a) represented by a bold solid line indicates gradation data obtained from a video signal, and a waveform (b) represented by a slender solid line indicates gradation-converted data according to the present invention. If the gradation data acquired from the video signal increases with the lapse of time in stages, such as "000", "010", "011", "100" . . . the same conditions with FIG. 3, the gradation data obtained from the video signal is changed from "000" into "010" at the point of time t1. Thus, the gradation-converted value, that is, the gradation data provided to the LCD panel, is set to "100" in the same manner with the prior art. At the point of time t2, when comparing the previous gradation data with the current one based on the gradation data obtained from the video signal, the previous gradation data is "010" and the current gradation data is "011", which means that the current gradation data value increases from the previous value by "001". Accordingly, the gradation-converted data will be set to "100" that is increased by "001" from the current gradation data value "011" (referring to FIG. 3). However, when comparing the gradation data "100" that was previously displayed through the LCD panel with the current gradation data "011" at the point of time t2, the current gradation data value rather decreases by "001" than the previous value. Accordingly, the gradation-converted data is set to "010", for example, which is "001" smaller than "011".

Subsequently, at the point of time t3, the resultant value becomes "110" by comparing "1010" with "100" in the present invention shown in FIG. 4, while the resultant value becomes "101" by comparing "011" with "100" in the prior art shown in FIG. 3. That is, it can be noted that the gradation-converted data value fluctuates sharply centering around the original gradation data value in accordance with the present invention shown in FIG. 4, whereas, the gradation-converted data value is slightly increased according to the prior art shown in FIG. 3. In other words, the high response speed of the LCD panel can be effectively achieved if the gradation conversion is executed based on the gradation data that was actually displayed on the LCD panel.

Figure 5A:
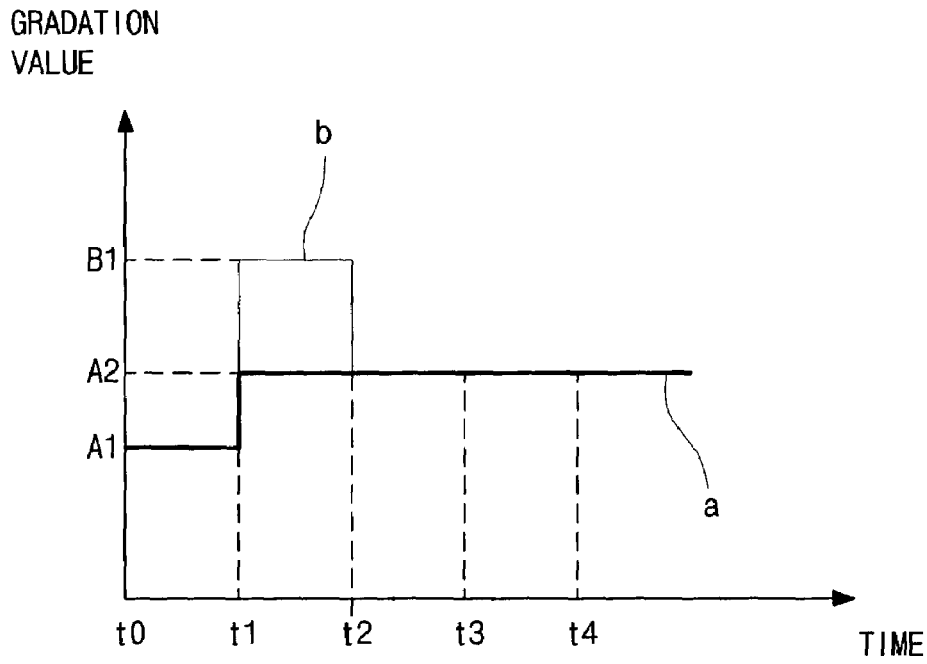
Figure 5B:
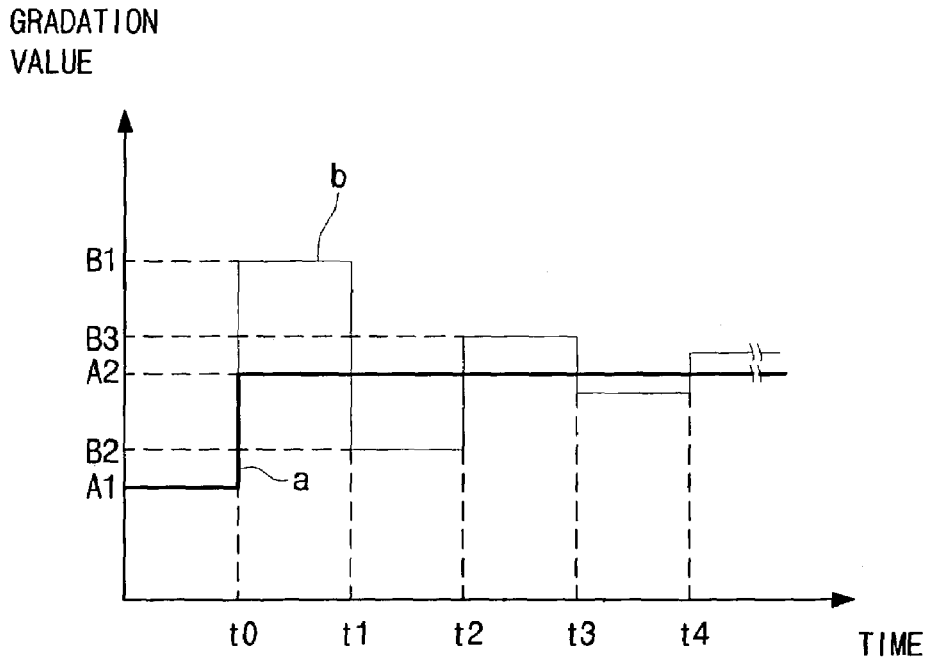

FIGS. 5*a* and 5*b* show examples that the gradation values obtained from the video signal increase from A1 to A2 at the point of time t0, and then the values are maintained for a predetermined period. FIGS. 5*a* and 5*b* denote resultant values of gradation conversion according to the prior art and the present invention, respectively. In FIGS. 5*a* and 5*b*, a waveform (a) represented by a bold solid line indicates gradation data acquired from the video signal and a waveform (b) represented by a slender solid line indicates gradation-converted data, respectively.

In the example of the prior art shown in FIG. 5*a*, since the original gradation data varies once at the point of time t0, the gradation-converted data is also changed once at the point of time t0, and then maintained uniformly. In case of the present invention shown in FIG. 5*b*, since the gradation conversion of data is carried out based on the gradation data that was provided to the LCD panel, i.e., the previous gradation-converted data, the gradation-converted data fluctuates sharply (or vibration-converges) on the basis of the original gradation data, as represented by the waveform (b) in FIG. 5*b*.

As shown in FIGS. 4, and 5*b*, when the gradation conversion is executed based on the gradation data that was previously displayed on the LCD panel, the gradation-converted data value fluctuates sharply (or vibration-converges) on the basis of the original gradation data value. Accordingly, if the gradation data values converted for a specific period are averaged, the averaged value is similar to the value obtained by averaging the original gradation data values, which enables a high response speed of the LCD panel without affecting output images.

In addition, according to the present invention, since the gradation-converted data value is similar to the original gradation data value when they are averaged for a specific period as above described in detail, it is possible to set the fluctuation range of the gradation-converted data value represented by the waveform (b) in FIG. 5*b* wider than that of the prior art. In other words, when comparing the prior art shown in FIG. 5*a* with the present invention depicted in FIG. 5*b*, the gradation data value converted at the point of time t0 according to the present invention can be set larger than that of the prior art. Consequently, this makes the difference between the previous gradation value and the current one larger, enhancing the response speed of the STN-LCD.

Figure 6:
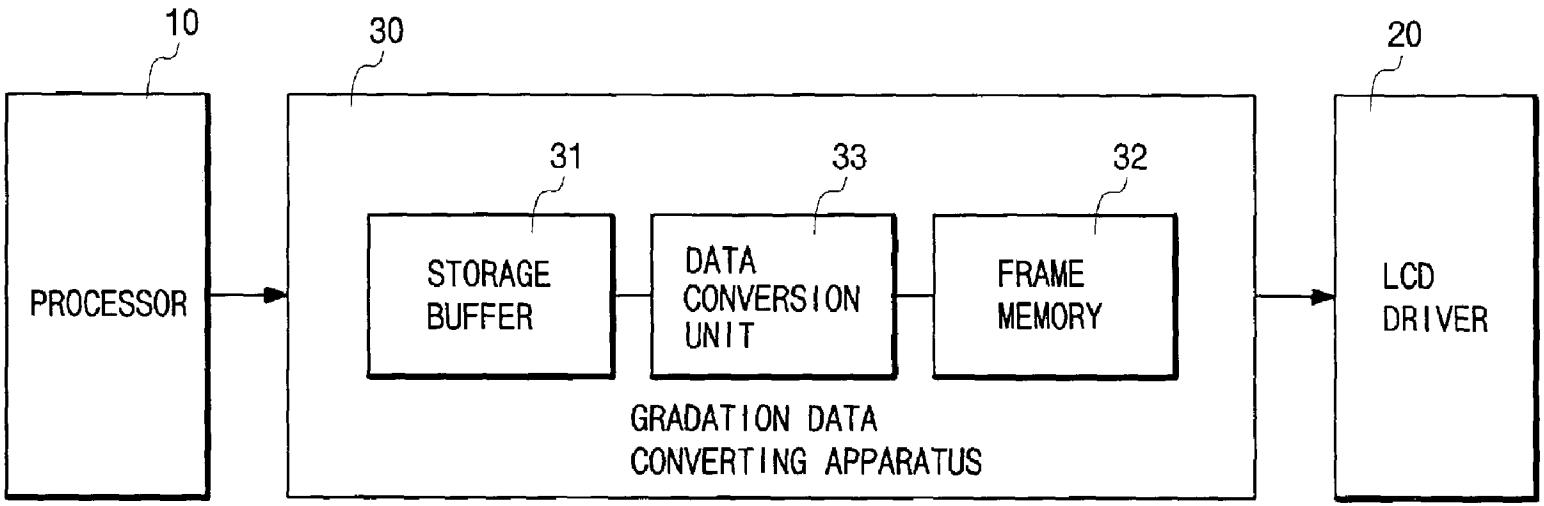
FIG. 6 is a block diagram showing a configuration of a gradation data converting apparatus 30 for an STN-LCD according to the present invention.

Next, referring to FIG. 6 is a block diagram of the gradation data converting apparatus for the STN-LCD according to a preferred embodiment of the present invention, reference numeral 10 denotes a processor for processing video data to generate gradation data against each pixel, and numeral 20 represents an LCD driver for driving the STN-LCD based on a driving signal input thereto. The processor 10 and the LCD driver 20 are not specified for the present invention but general components. Reference numeral 30 denotes a gradation data converting apparatus for converting the gradation data input from the processor 10. The gradation data converting apparatus 30 includes three data conversion units 33 for processing each of R (Red), G (Green) and B (Blue) color data. However, since the data conversion units 33 for the R, G and B color data have the same configuration, only one unit 33 for processing one color data will be explained hereinafter.

The gradation data converting apparatus 30 further includes a storage buffer 31 for storing gradation data input from the outside and a frame memory 32 for storing gradation data for driving the LCD. The data conversion unit 33 converts the gradation data stored in the storage buffer 31 to store the converted data in the frame memory 32. The data conversion unit 33 detects variations in the gradation values of all pixels displayed on the LCD based on the gradation data input thereto and executes data conversion according to the detected variations. The data conversion unit 33 includes a predetermined operation processor. The operation processor compares the gradation data stored in the storage buffer 31 with the gradation data stored in the frame memory 32 to calculate the differences between them, and carries out data conversion based on the obtained differences. The gradation conversion according to the operation processor will be explained in detail with reference to a flow chart of FIG. 7.

Figure 7:
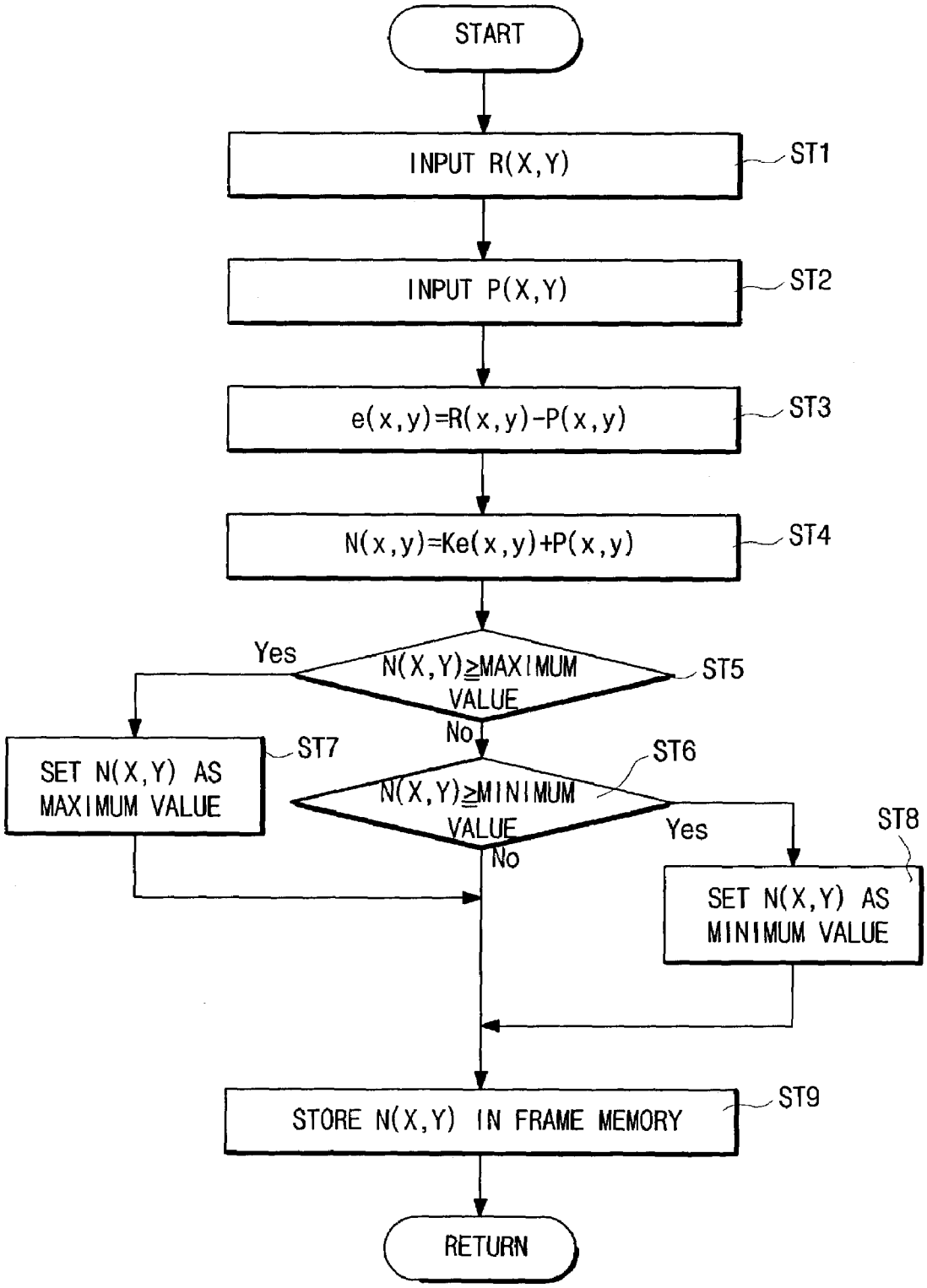
FIG. 7 is a flow chart for explaining the operation of the gradation data converting apparatus 30 of FIG. 6.

In FIG. 7, when the gradation data converting apparatus 30 starts operation, the data conversion unit 33 reads a gradation value R stored in the storage buffer 31 and a gradation value P corresponding to the value R, stored in the frame memory 32, that is, the gradation value that was previously displayed on the LCD at the steps ST1 and ST2, and calculates a difference (e) between the two values at the step ST3. Subsequently, the data conversion unit 33 multiples the calculated difference (e) by a predetermined factor K to acquire a correction value. Then, it adds the obtained correction value to the previous gradation value P stored in the frame memory 32 to produce a new gradation value N at the step ST4. Here, the factor K is an experimental value and set to a positive value larger than 1. Specifically, the factor value is determined according to a peculiar response characteristic of the LCD applied to the present invention. Next, the data conversion unit 33 stores the new gradation value N in the frame memory 32 at the step ST9. More specifically, the data conversion unit judges whether the new gradation value N is larger than a maximum gradation value or smaller than a minimum gradation value at the steps ST5 and ST6. When the new gradation value N is decided lager than the maximum gradation value, the maximum value is set to a new gradation value N at the step ST7. On the other hand, if it is detected smaller than the minimum gradation value, the minimum value is set to a new gradation value N at the step ST8. In addition, the data conversion unit 33 continuously repeats this data conversion processing for the gradation data stored in the storage buffer 31 and the frame memory 32 until the display operation is finished.

The aforementioned operation will be explained again with reference to FIG. 5*b*. When a gradation data R corresponding to the gradation level "A2" is stored in the storage buffer 31 at the time t0 in FIG. 5*b*, the data conversion unit 33 compares the gradation data with a previous gradation value displayed previously, that is, the gradation value P stored in the frame memory 32, for example "A1", to calculate the difference (e) between them. Then, the data conversion unit 33 multiples the obtained difference (e) by a predetermined factor K to generate a correction value and adds the correction value to the previous gradation value P, thereby producing a new gradation value N, i.e., "B1" represented by the waveform (b). The new gradation value N is stored in the frame memory 32. In this case, accordingly, a driving signal corresponding to the gradation value "B1" is applied to the LCD driver 20.

Subsequently, at the point of time t1, the gradation value corresponding to "A2" is stored in the storage buffer 31 and the gradation value P corresponding to "B1" is stored in the frame memory 32. The data conversion unit 33 calculates a correction value in the same manner. Specifically, the data conversion unit 33 subtracts the gradation value P corresponding to "B1", stored in the frame memory 32, from the gradation value R corresponding to "A2", stored in the storage buffer 31, and then multiplies the subtracted result by the factor K, thereby obtaining a predetermined correction value. The data conversion unit 33 adds the obtained correction value to the previous gradation value corresponding to "B1" to generate a new gradation value N. Here, since the correction value has a negative value, the new gradation value N is equivalent to the value, acquired by subtracting Ke from the gradation value corresponding to "B1", i.e., "B2" of FIG. 5*b*. The new gradation N is stored in the frame memory 32. In this case, accordingly, a driving signal corresponding to the gradation value "B2" is supplied to the LCD driver 20. Continuously, the above-described operation is carried out for subsequent gradation data so as to generate gradation-converted data that fluctuates sharply (or vibration-converges), as indicated by the waveform (b), on the basis of the original gradation data value represented by the waveform (a) in FIG. 5*b*. Then, the gradation-converted data is applied to the LCD driver 20. Here, the fluctuation magnitude or range of the waveform (b) is determined by the factor K. This factor K will be set to an appropriate value according to peculiar characteristics of the LCD panel, to which the present invention is applied.

In the above-described present invention, the gradation-converted data is generated based on the gradation data that was actually displayed on the LCD panel and the current gradation data. Accordingly, since a series of gradation-converted data values fluctuate sharply on the basis of the original gradation values, as shown in FIG. 4 and 5*b*, it is possible to enhance the response speed of the STN-LCD without affecting output images.

Figure 8:
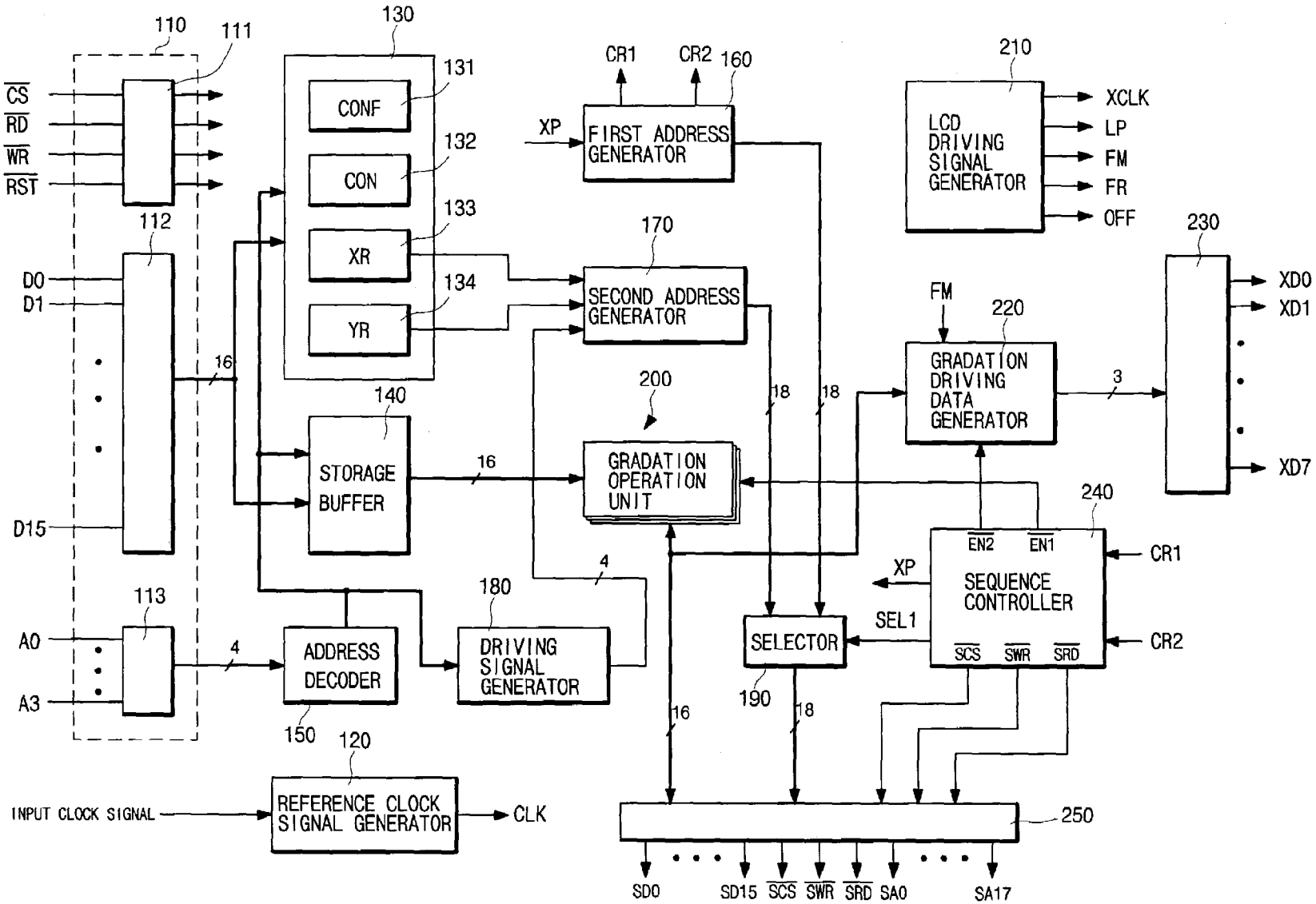
FIG. 8 is a block diagram showing an example of a detailed configuration of the gradation data converting apparatus 30 of FIG. 6.

Next, referring to FIG. 8, a block diagram showing an example of a detailed configuration of the gradation data converting apparatus 30 of FIG. 6, reference numeral 110 denotes an input port for interfacing with an external device, for example, the processor 10, shown in FIG. 6, that inputs R, G, B digital video data to the apparatus 30. The input port 110 includes a control port 111 for receiving control signals such as a chip select signal $\overline{CS}$, a read signal $\overline{RD}$, a write signal $\overline{WR}$ and a reset signal $\overline{RST}$, a data port 112 for accepting data, and an address port 113 for receiving address data. A reference clock signal generator 120 generates a reference clock signal CLK of 100 MHz from an external input clock signal of 50 MHz, for example. A register unit 130 includes a configure register CONF 131 storing select data for selecting whether or not a frame inversion signal FR or M is generated, a control register CON 132 storing control data for turning on/off the display, an XR register 133 storing X-axis (horizontal-axis direction) position data on the LCD panel of the gradation data stored in a storage buffer 140, which will be described later, and a YR register 134 storing Y-axis (vertical-axis direction) position data on the LCD panel of the gradation data stored in the storage buffer 140. The storage buffer 140 is used for storing gradation data. The gradation data stored in the storage buffer 140 consists of sixteen bits data including 5-bit R(Red) data, 6-bit G(Green) data and 5-bit B(Blue) data, where the number of colors to be displayed on the LCD panel is 60,000, for instance. An address decoder 160 decodes 4-bit address data, for example, input through the address port 113, to generate an enable signal for selectively driving the registers of the register unit 130, i.e., COMF register 131, CON register 132, XR register 133 and YR register 134 and the storage buffer 140. A first address generator 160 generates address data of a frame memory (not shown) that stores gradation data corresponding to a scan position on the LCD panel, that is, the position of a dot on the LCD panel, currently driven. The dot means a single picture point composed of three pixels of R, G and B.

Figure 9:
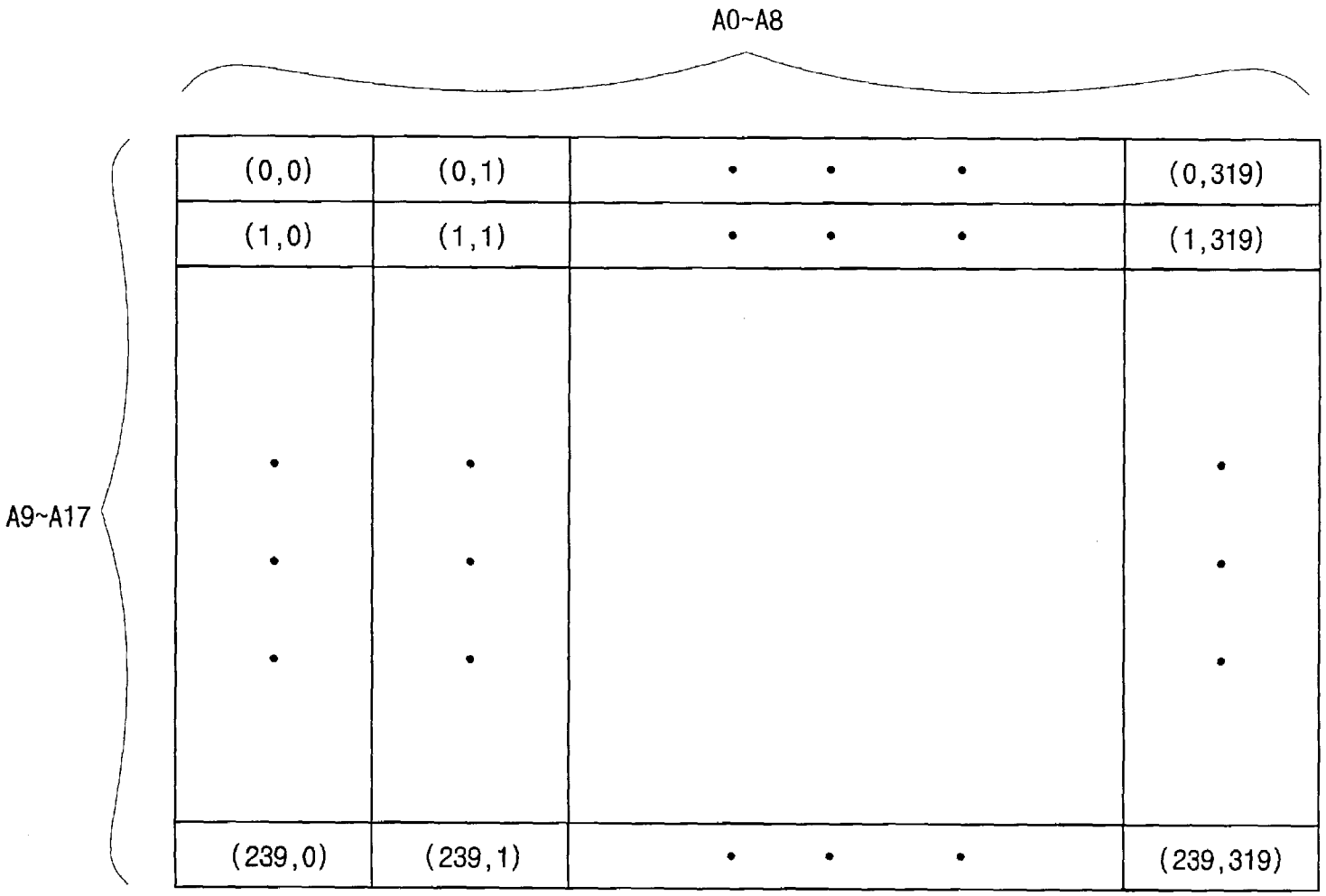
FIG. 9 shows an example of the structure of a frame memory employed by the present invention.

FIG. 9 illustrates an example of the structure of the frame memory employed by the present invention, which corresponds to the LCD panel having a size of 320×240 dots (width×length). The frame memory includes a storage area corresponding to each dot on the LCD panel, and each storage area consists of a 16-bit data storage region for storing R, G, B data. Address data is composed of 18 bits of A0 to A17. Here, the lower 9 bits, A0 to A8, correspond to the X-axis of the LCD panel, while the upper 9 bits, A9 to A17, correspond to the Y-axis of the LCD panel.

Figure 10:
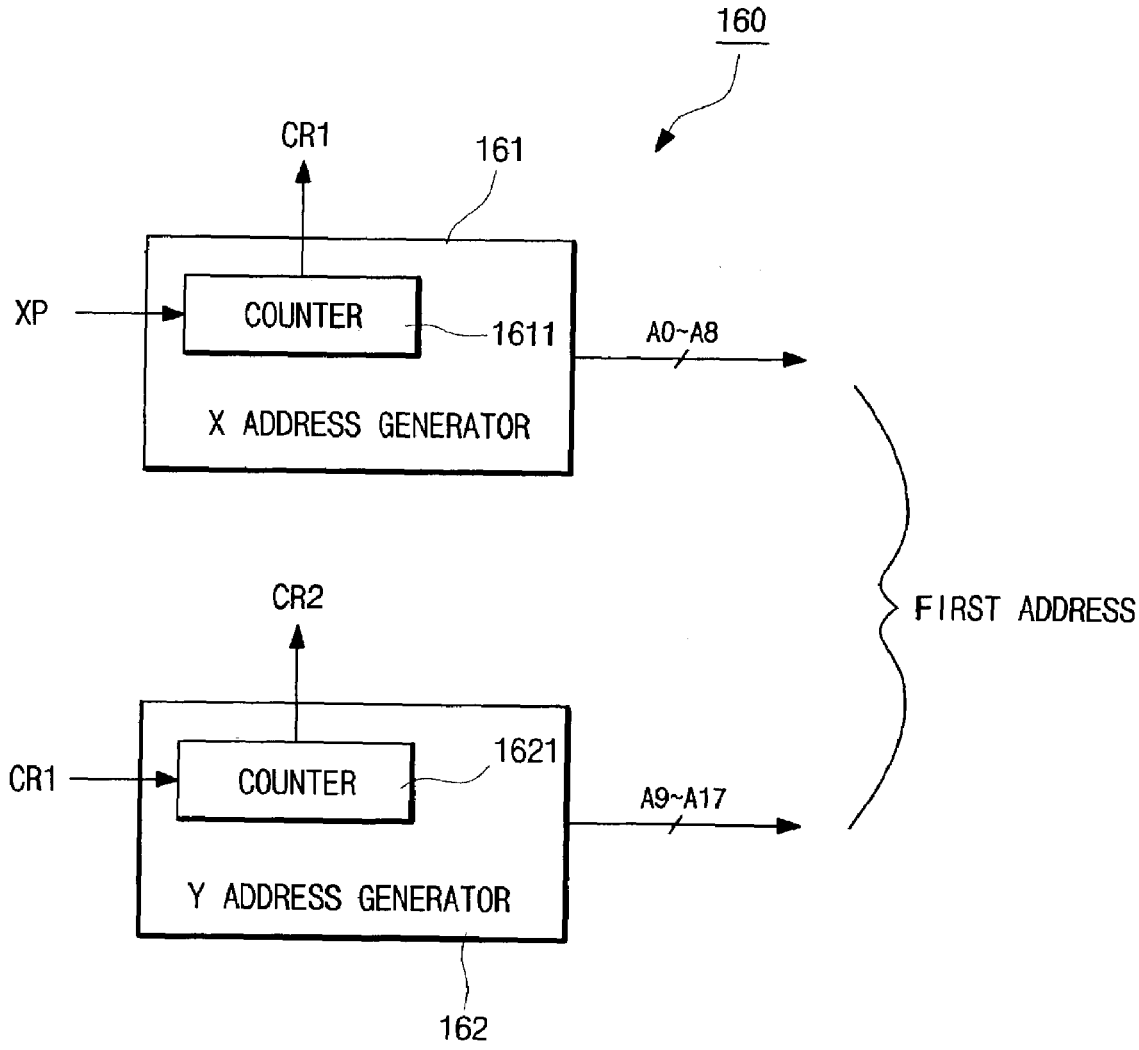
FIG. 10 is a block diagram showing an example of a detailed configuration of a first address generator 160 of FIG. 8.

FIG. 10 is a block diagram showing an example of a detailed configuration of the first address generator 160. The first address generator 160 includes an X address generator 161 for generating the lower 9-bit address data A0 to A8 corresponding to the X-axis of the LCD panel, and a Y address generator 162 for generating the upper 9-bit address data A9 to A17 corresponding to the Y-axis of the LCD panel. The X address generator 161 includes a counter 1611 for counting a clock signal XP applied from a sequence controller 240. The sequence controller 240 applies the clock signal XP to the first address generator 160 when the operation of outputting gradation data with respect to one picture point is executed, thereby increasing the count value of the counter 1611 of the X address generator 161 by "1". The counter 1611 repeatedly down-counts 320 if the size of the LCD panel is 320×240 dots, and generates a predetermined carry signal CR1 when its count value becomes "0". The X address generator 161 generates the lower 9-bit address data A0 to A8 of the frame memory, corresponding to the X-axis of the LCD panel, based on the counted value of the counter 1611. The Y address generator 162 includes a counter 1621 for counting the carry signal CR1 output from the X address generator 161. This counter 1621 repeatedly down-counts 320 when the size of the LCD panel is 320×240 dots, and generates a predetermined carry signal CR2 when its count value becomes "0". The Y address generator 162 generates the upper 9-bit address data A9 to A17 of the frame memory, corresponding to the Y-axis of the LCD panel, based on the counted value of the counter 1621. The second address generator 170 generates position data of gradation data, stored in the storage buffer 140, on the LCD panel, i.e., address data of the frame memory in which corresponding gradation data should be stored.

Figure 11:
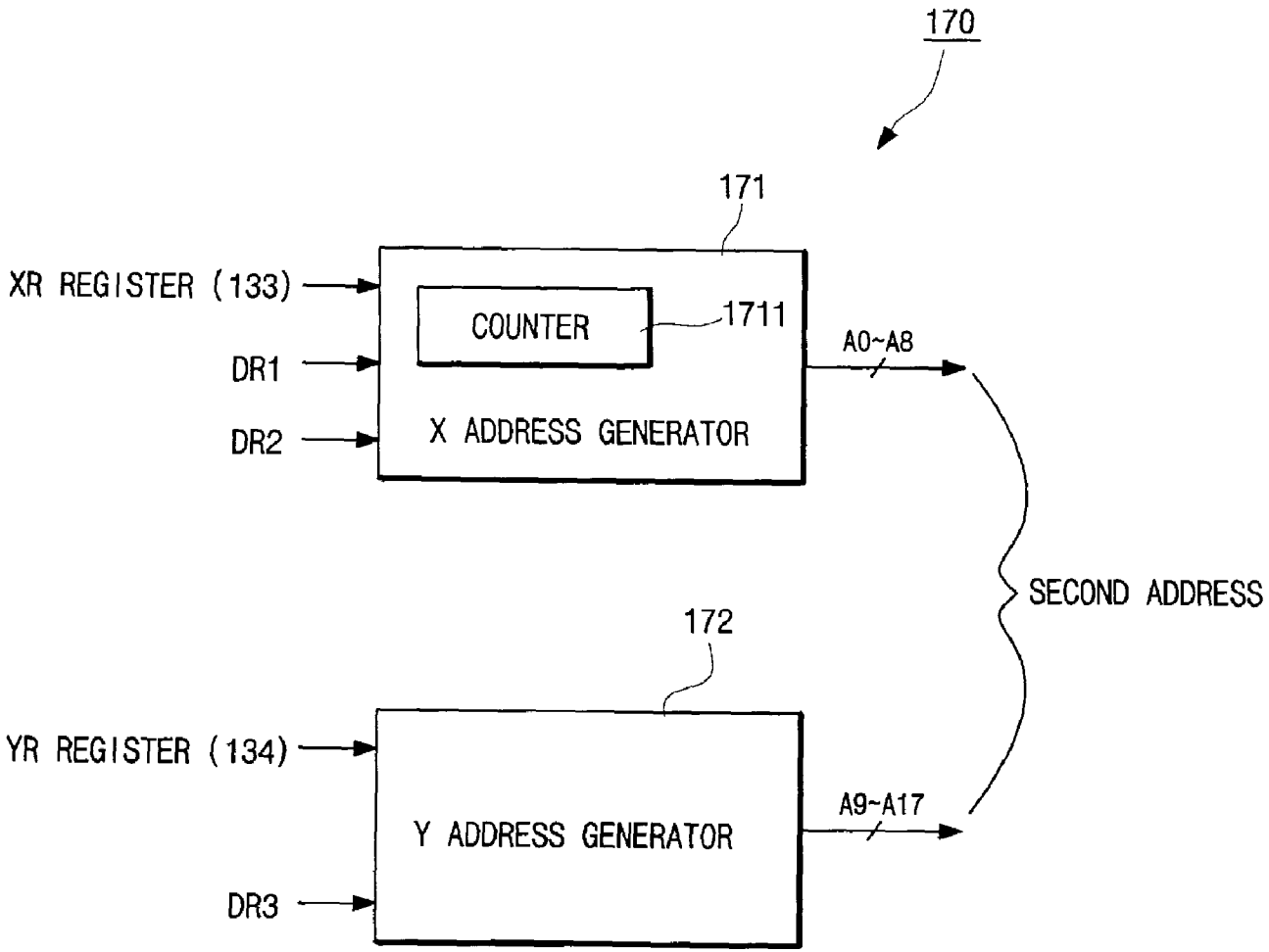
FIG. 11 is a block diagram showing an example of a detailed configuration of a second address generator 170 of FIG. 8.

FIG. 11 is a block diagram showing an example of a detailed configuration of the second address generator 170. The second address generator 170 includes an X address generator 171 for generating lower 9-bit address data A0 to A8, and a Y address generator 172 for generating upper 9-bit address data A9 to A17. Here, the X address generator 171 generates X address data on the basis of a data value stored in the XR register 133 and predetermined first and second driving signals DR1 and DR2, and the Y address generator 172 generates Y address data based on a data value stored in the YR register 134 and a predetermined third driving signal DR3. The first, second and third driving signals DR1, DR2 and DR3 are provided by the driving signal generator 180.

Figure 12:
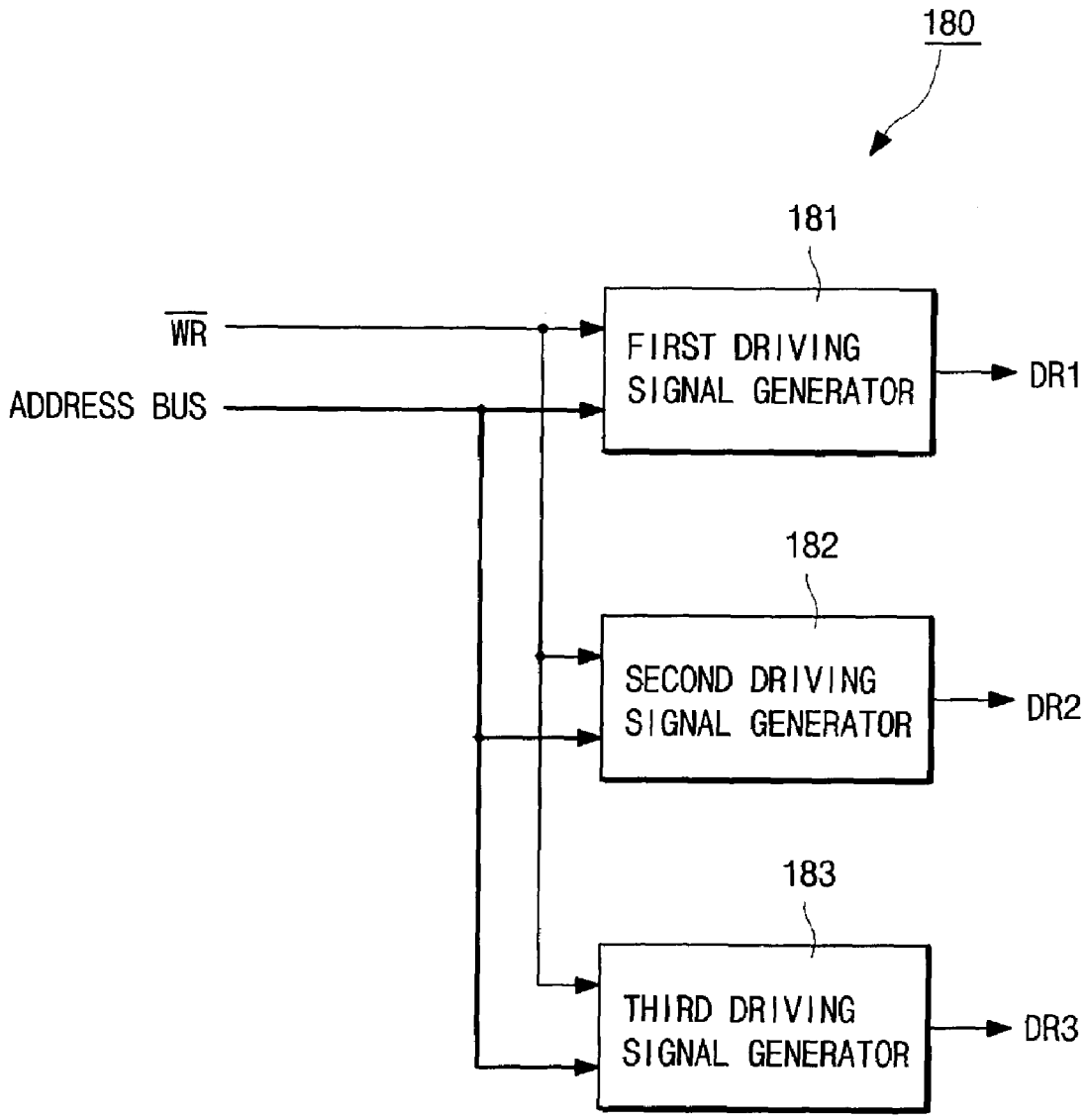
FIG. 12 is a block diagram showing an example of a detailed configuration of a driving signal generator 180 of FIG. 8.

FIG. 12 is a block diagram showing an example of a detailed configuration of the driving signal generator 180. The driving signal generator 180 includes first, second and third driving signal generation units 181, 182 and 183 that respectively generate the first, second and third driving signals DR1, DR2 and DR3 on the basis of address data on an address bus and the write signal $\overline{WR}$. Here, the first driving signal generator 181 creates the first driving signal DR1 based on address data with respect to the XR register 133 and the write signal $\overline{WR}$. Specifically, the first driving signal generator 181 outputs the first driving signal DR1 when the address data and the write signal $\overline{WR}$ are provided to the XR register 133 so that the LCD X-axis position data of the gradation data stored in the storage buffer 140 is stored in the XR register 133. The second driving signal generator 182 generates the second driving signal DR2 based on address data with respect to the storage buffer 140 and the write signal $\overline{WR}$. Specifically, the second driving signal generator 182 outputs the second driving signal DR2 when the gradation data is stored in the storage buffer 140 according as the address data and the write signal $\overline{WR}$ are applied to the storage buffer 140. The third driving signal generator 183 creates the third driving signal DR3 on the basis of address data with respect to the YR register 134 and the write signal $\overline{WR}$. That is, the third driving signal generator 183 outputs the third driving signal DR3 when the LCD Y-axis position data of the gradation data stored in the storage buffer 140 is stored in the YR register 134 according as the address data and the write signal $\overline{WR}$ are provided to the YR register 134.

Referring back to FIG. 8, when an external processor stores a series of gradation data items in the storage buffer 140, the processor stores the initial position data on the LCD panel on which the gradation data items are displayed in the XR register 133 and the YR register 134. The processor does not store position data of subsequent gradation data items on the same scan line in the registers 133 and 134 but sequentially stores them in the storage buffer 140.

In the second address generator 170 of FIG. 11, the X address generator 171 includes a counter 1711. The counter 1711 sets the data value stored in the XR register 133 as the initial value when the first driving signal DR1 is applied thereto, and then up-counts the set data value one by one when the second driving signal DR2 is applied thereto. The X address generator 171 generates and outputs the lower 9-bit address data A0 to A8 of the frame memory, corresponding to the value counted by the counter 171, i.e., the X position value on the LCD panel. The Y address generator 172 generates and outputs the upper 9-bit address data A9 to A17 of the frame memory, corresponding to the data value stored in the YR register 134, that is, the Y position value on the LCD panel, when the third driving signal DR3 applied thereto. Accordingly, the second address generator 170 generates the address data of the frame memory in which the gradation data recorded in the storage buffer 140 should be stored. The first address data generated by the first address generator 160 and the second address data generated by the second address generator 170 are input to a selector 190. The selector 190 selectively applies the first address data and the second address data to the frame memory according to a select signal SEL1 from the sequence controller 240, which will be explained later. A gradation operation unit 200 includes three operation parts that respectively process R, G and B gradation data items. The gradation operation unit 200 executes a predetermined operation processing on the basis of the currently input gradation data stored in the storage buffer 140 and the gradation data stored in the frame memory, i.e., the gradation data that was previously displayed on the LCD panel, to generate gradation data to be subsequently displayed on the LCD panel. More specifically, the gradation operation unit 200 subtracts the previous gradation data stored in the frame memory from the current gradation data stored in the storage buffer 140, and then multiplies the subtracted result by the factor K. Subsequently, the gradation operation unit 200 adds the multiplied result to the previous gradation data stored in the frame memory, thereby generating new gradation data. This new gradation data is stored in a corresponding storage area of the frame memory. The calculating operation of the gradation operation unit 200 and the operation of storing the resultant data in the frame memory are performed according to an enable signal $\overline{\text{EN1}}$ from the sequence controller 240, which will be explained later. Furthermore, the gradation operation unit 200 includes a status register, not shown, for storing gradation conversion processing status. The gradation operation unit 200 stores status data "1", e.g., in the status register when the gradation conversion has been carried out for the gradation data currently stored in the storage buffer 140, and stores status data "0" in the status register when time gradation conversion has not been carried out. The sequence controller 240, which will be described Later, refers the status data. An LCD driving signal generator 210 generates a clock signal XCK for driving the LCD panel, a line pulse LP, a frame pulse FM, a frame inversion signal FR and a display on/off signal OFF.

Figure 13:
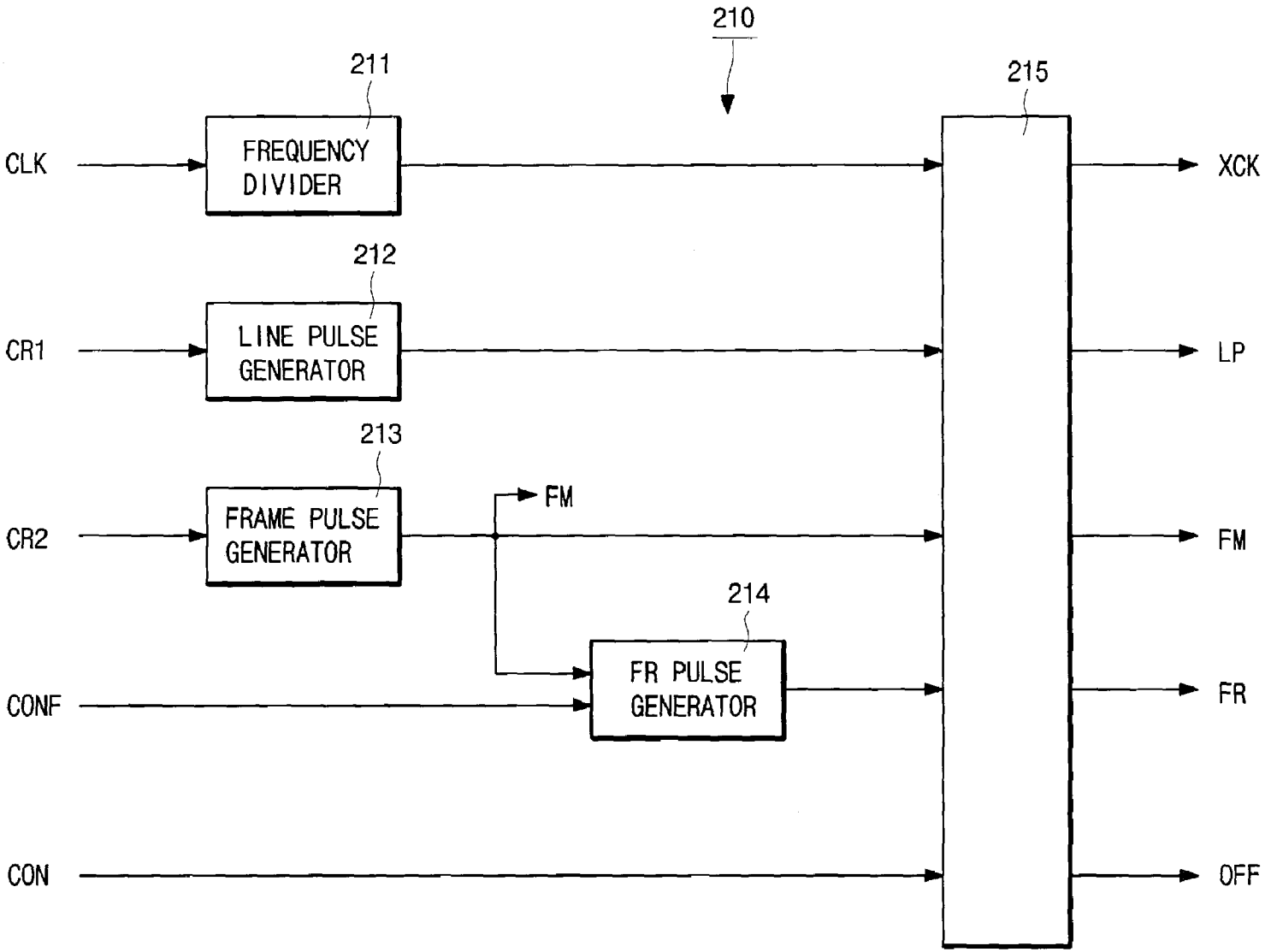
FIG. 13 is a block diagram showing an example of a detailed configuration of an LCD driving signal generator 210 of FIG. 8.
Figure 14:
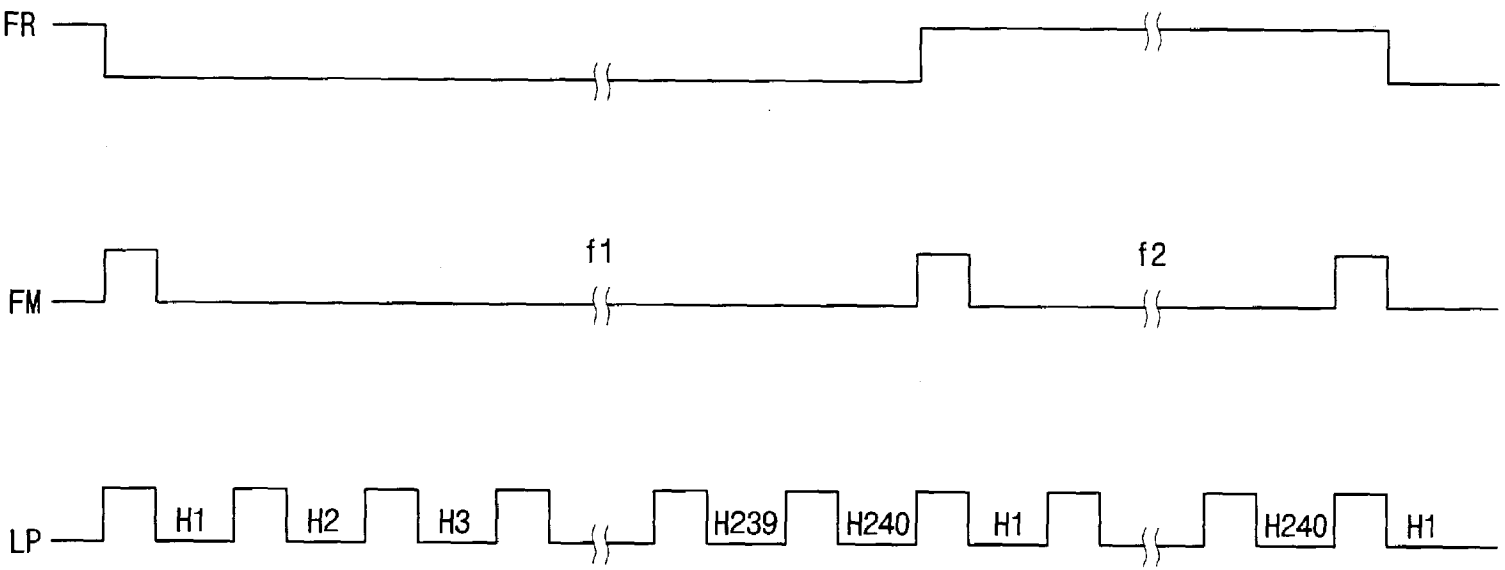
FIG. 14 is a signal waveform diagram showing an example of an LCD driving signal output from the LCD driving signal generator 210 of FIG. 8.

FIG. 13 is a block diagram showing an example of a detailed configuration of the LCD driving signal generator 210. The LCD driving signal generator 210 includes a frequency divider 211 for frequency-dividing the reference clock signal of 100 MHz, e.g., generated by the reference clock signal generator 120 of FIG. 8 to generate the clock signal XCK of 12.5 MHz, e.g., required for the LCD panel, a line pulse generator 212 for generating the line pulse LP based on the first carry signal CR1 output from the first address generator 160, a frame pulse generator 213 for generating the frame pulse FM on the basis of the second carry signal CR2 output from the first address generator 160, an FR pulse generator 214 for generating the frame inversion signal FR based on the frame pulse FM generated by the frame pulse generator 213 and the select data stored in the CONF register 132, and an output port 215 for transmitting these LCD driving signals to the LCD panel. In FIG. 13, "OFF" denotes the display on/off signal that is output based on the control data stored in the CON register 132. FIG. 14 shows an example of driving signals supplied from the LCD driving signal generator 210 to the LCD panel when the LCD panel has the size of 320×240 dots.

A gradation driving data generator 220, shown in FIG. 8, generates gradation driving data for driving each pixel of the LCD panel on the basis of the gradation data stored in the frame memory.

Figure 15:
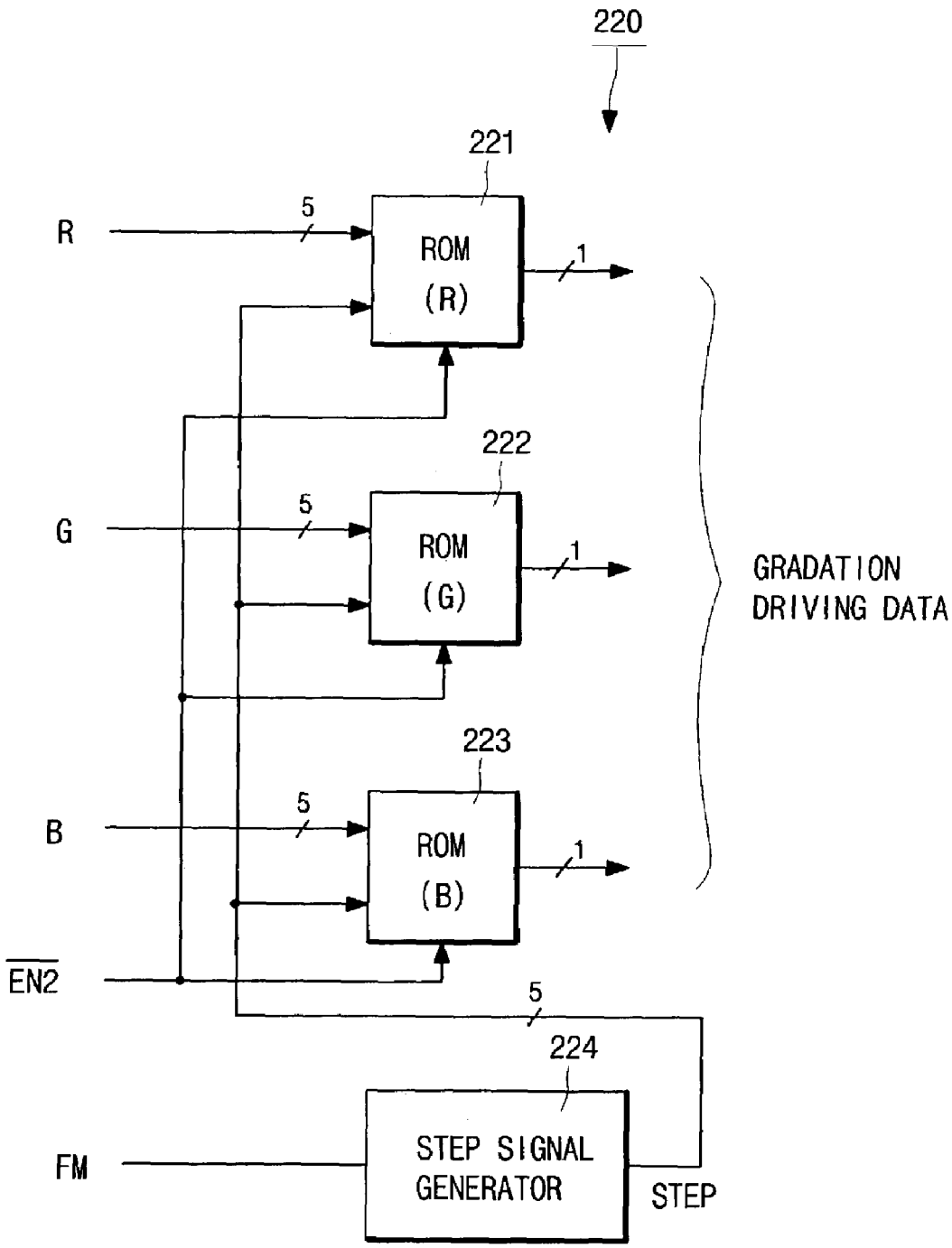
FIG. 15 is a block diagram showing an example of a detailed configuration of a gradation driving data generator 220 of FIG. 8.

FIG. 15 is a block diagram showing an example of a detailed configuration of the gradation driving data generator 220. The gradation driving data generator 220 includes ROM tables 221, 222 and 223 for respectively generating gradation driving data items for R, G and B gradation data items, and a step signal generator 224 for generating a step signal based on the frame pulse FM.

Figure 16:
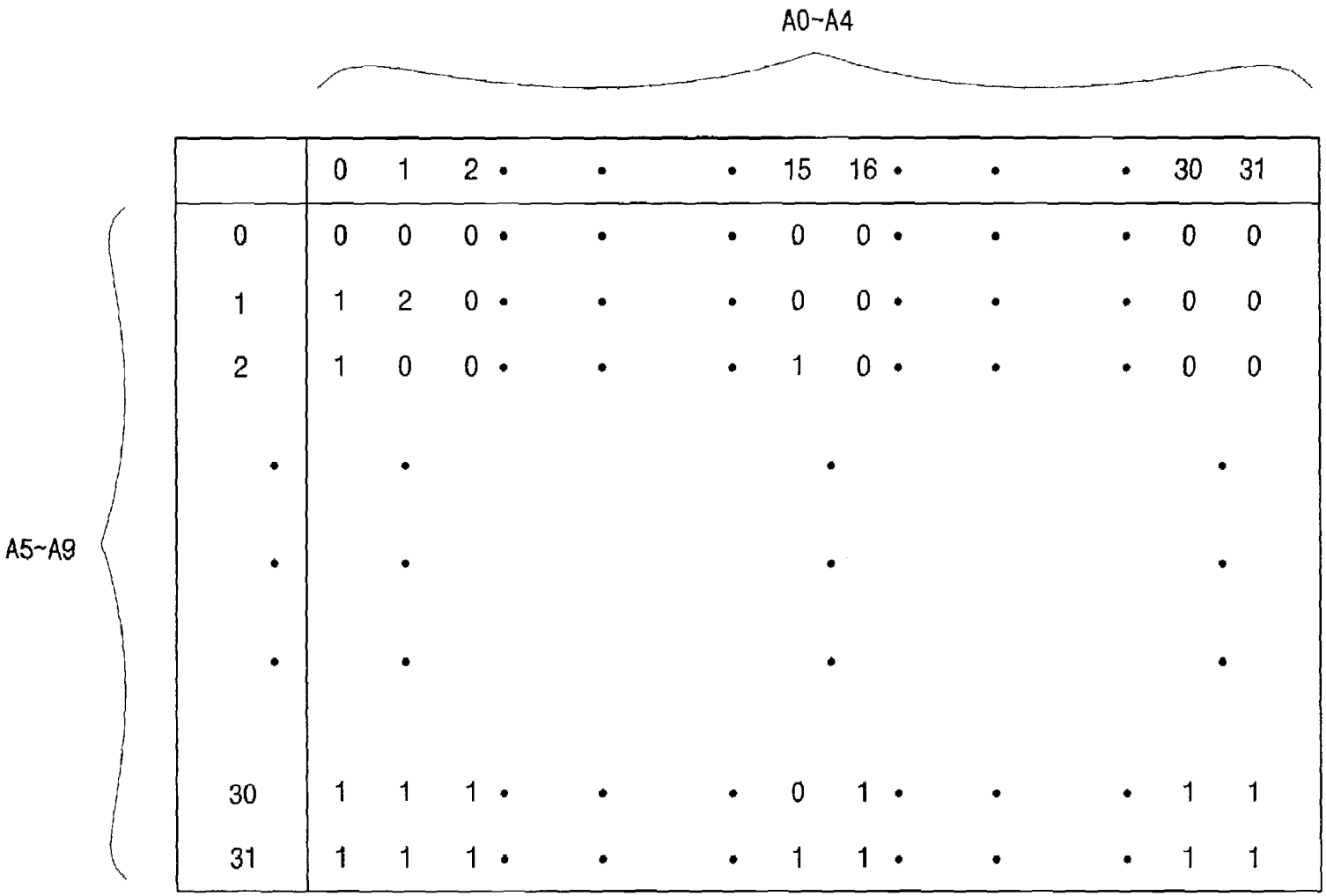
FIG. 16 shows an example of the structure of the ROM table of FIG. 15.

FIG. 16 shows an example of the structure of each of the ROM table. Each ROM table accepts 5-bit gradation data supplied from the frame memory as upper address data A5 to A9 and receives a 5-bit step signal as lower address data A0 to A4. While the gradation data output from the frame memory consists of sixteen bits including 5-bit R gradation data, 5-bit B gradation data and 6-bit G gradation data, upper one-bit of the G gradation data is set to an unused state. Each of the ROM tables 221, 222 and 223 outputs a one-bit gradation driving signal corresponding to the 10-bit address data A0 to A9 composed of the gradation data and the step signal when an enable signal $\overline{\text{EN2}}$ is supplied thereto from the sequence controller 240.

In FIG. 8, reference numeral 230 denotes a gradation driving data output unit that generates 8-bit gradation driving data XD0 to XD7 based on the gradation driving data supplied from the gradation driving data generator 220. The gradation driving data output unit 230 receives the R, G and B gradation driving data items, output from the ROM tables 221, 222 and 223 respectively, and combines them in unit of 8 bits to output it to the LCD panel. The sequence controller 240 controls the entire operation sequence of the gradation data converting apparatus of the invention using the first and second carry signals CR1 and CR2 output from the first address generator 150 as reference signals. Especially, the sequence controller 240 outputs the enable signal $\overline{\text{EN2}}$ to the gradation driving data generator 220 to control outputting of the gradation driving data, and outputs the enable signal $\overline{\text{EN1}}$ to the gradation operation unit 200 to control the operation of the gradation data stored in the storage buffer 140 and the gradation data stored in the frame memory. In addition, the sequence controller 240 outputs the enable signal $\overline{\text{EN2}}$ to the gradation driving data generator 220 to execute the display operation for one pixel, and then applies the clock signal XP to the first address generator 160 so as to increase the count value of the counter 1611 of the X address generator 160 by "1". That is, the sequence controller 240 increases the count value of the counter 1611 by "1" to increase the first address data output from the first address generator by "1" in the X-axis direction when the display operation for one pixel is finished.

In FIG. 8, reference numeral 250 denotes an interface for interfacing with the external frame memory. The operation of the gradation data converting apparatus of the invention with the configuration described above will now be explained below. In the gradation data converting apparatus shown in FIG. 8, the operation of storing input gradation data in the storage buffer 140 and the operation of outputting of gradation data for the LCD panel are independently performed. First, the input gradation data is directly stored in the storage buffer 140 by the external processor. The external processor stores gradation data to be subsequently displayed in the storage buffer 140 through a data bus and address bus and, simultaneously, stores data of a position on the LCD panel at which the corresponding gradation data should be displayed in the XR and YR registers 133 and 134.

When the gradation data is stored in the storage buffer 140 in this manner, the address generating means including the driving signal generator 180 and the second address generator 170 operates to generate address data corresponding to the display position of the gradation data stored in the storage buffer 140, i.e., address data of the frame memory where the gradation data should be stored, to output the address data to the second address generator 170. The operation of outputting the gradation data for the LCD panel is executed according to the cooperative operation of the sequence controller 240 and the gradation driving data generator 220. The sequence controller 240 controls the selector 190 to apply the first address data output from the first address generator 160, i.e., the address data of the frame memory corresponding to a current scan position of the LCD panel, to the frame memory. In addition, the sequence controller 240 outputs a chip select signal $\overline{SCS}$ and a read signal $\overline{SRD}$ to the frame memory to apply gradation data corresponding to the first address data to the gradation driving data generator 220 as its input. Furthermore, the sequence controller 240 supplies the enable signal $\overline{EN2}$ to the gradation driving data generator 220 so as to output gradation driving data corresponding to the gradation data.

In the meantime, the data conversion processing operation for the gradation data stored in the storage buffer 140 and the operation of storing the resultant data in the frame memory are carried out by the sequence controller 240 in association with the operation of outputting the gradation data.

Figure 17:
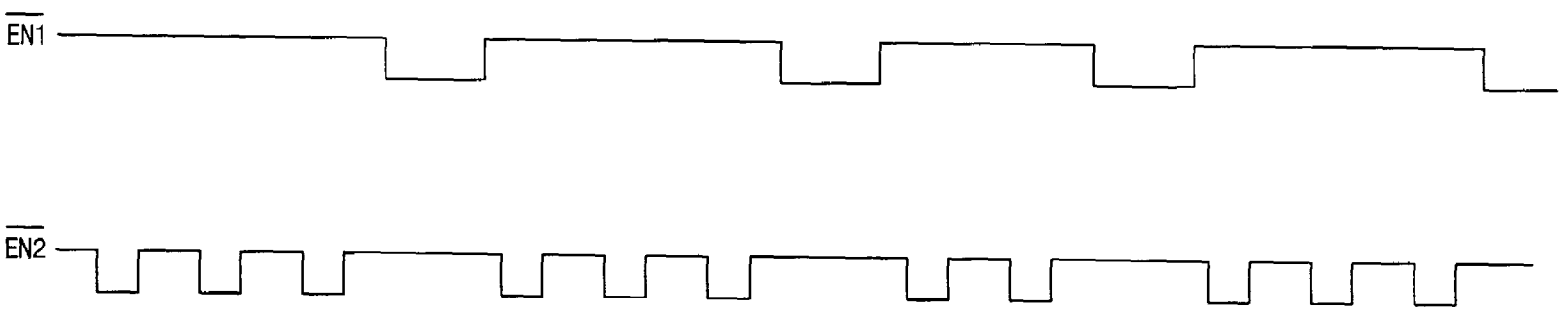
FIG. 17 is a signal waveform diagram showing an example of enable signals $\overline{\text{EN1}}$ and $\overline{\text{EN2}}$ output from the sequence controller 240 of FIG. 8.

FIG. 17 shows the enable signals $\overline{EN1}$ and $\overline{EN2}$ supplied from the sequence controller 240 to the gradation operation unit 200 and the gradation driving data generator 220. The sequence controller 240 outputs three or two enable signals $\overline{EN2}$ to the gradation driving data generator 220 to control the gradation driving data generator 220 to output, e.g., 8-bit gradation driving data, and then outputs the enable signal $\overline{EN1}$ to the gradation operation unit 200 to process the gradation data stored in the storage buffer 140 appropriately. Through the cooperative operation of the sequence controller 240 and gradation driving data generator 220, the one-bit gradation driving data is output from each of the ROM tables 221, 222 and 223 of the gradation driving data generator 220 at an operation speed of 30 ns approximately, and the external processors stores gradation data in the storage buffer 140 at an operation speed of about 200 ns. That is, the operation of generating the gradation driving data through the gradation driving data generator 220 is carried out considerably faster than the operation of storing the gradation data in the storage buffer 140. Accordingly, the sequence controller 240 can process the gradation data stored in the storage buffer 140 while smoothly providing the gradation driving data for the LCD panel. When the sequence controller 240 applies the enable signal $\overline{EN1}$ to the gradation operation unit 200, the gradation operation unit 200 converts the gradation data stored in the storage buffer 140 or stores the converted gradation data in the frame memory in cooperation with the sequence controller 240. More specifically, in case that the gradation data stored in the storage buffer 140 has been converted, which means that the aforementioned status register is set to "1", the gradation gradation operation unit 200 stores the convened data in the frame memory when the enable signal $\overline{EN1}$ is supplied thereto from the sequence controller 240. On the other band, when the gradation data stored in the storage buffer 140 has not been converted, that is, when the status register is set to "0", the gradation operation unit 200 converts the gradation data stored in the storage buffer 140 when provided with the enable signal $\overline{EN1}$ from the sequence controller 240. Here, the data conversion is carried out, as described above, in such a manner that the gradation data stared in the frame memory is subtracted from the gradation data stored in the storage buffer 140, the subtracted result is multiplied by a predetermined factor K, and the multiplied result is added to the previous gradation data stored in the frame memory. Furthermore, after the execution of data conversion or storing operation according to the enable signal $\overline{EN1}$,the gradation operation unit 200 varies the status data of the status register so that it is possible to inquire which operation will be subsequently carried out. Moreover, the sequence controller 240 inquires status data stored in the gradation operation unit 200 in the case where it applies the enable signal $\overline{EN1}$ to the gradation operation unit 200, thereby recognizing the current operation state of the gradation operation unit. At this time, when the status data is "1", which means that the gradation data stored in the storage buffer 140 has been converted, the sequence controller 240 controls the selector 190 to apply the address data generated by the second address generator 170 to the frame memory and, simultaneously, provides a write signal $\overline{SWR}$ to the frame memory to control the operation of storing the gradation data converted by the gradation operation unit 200 into the frame memory. On the other hand, when the status data is "0", that is, when the gradation data stored in the storage buffer 140 has not been converted, the sequence controller 240 controls the selector 190 to apply the address data generated by the second address generator 170 to the frame memory. Simultaneously, it provides the read signal $\overline{SRD}$ to the frame memory to read the previous gradation data stored in the memory, e.g., the previous gradation data corresponding to the gradation data stored in the storage buffer 140, to apply it to the gradation operation unit 200. Accordingly, the gradation operation unit 200 can convert the gradation data stored in the storage buffer 140.

Since the gradation data converting apparatus with the configuration describe above converts gradation data through the operation of the gradation operation unit 200, it is possible to omit the ROM table 30, which is indispensable for the configuration of the prior art shown in FIG. 4. Furthermore, the gradation data converting apparatus of the invention can cope with characteristics of the LCD panel to which the present invention is applied only by varying the factor K used for gradation operation process in the data conversion. Accordingly, the gradation data converting apparatus can be easily manufactured and the apparatus can meet various design specifications.

Moreover, the gradation data converting apparatus of the present invention can perform the data conversion and LCD panel display operation only by using a single frame memory, reducing its unit price.

In the meantime, though a specific value is used as the factor K for generating new gradation data in the aforementioned embodiment, the present invention can also use a variable value as the factor K. That is, the response speed of the STN-LCD is improved as the time-sequential variation range of gradation data provided to the LCD panel becomes large, as described above. Accordingly, when varying the factor K, which is multiplied to the difference between the gradation data that was displayed on the LCD panel previously and the current gradation data so as to increase the time-sequential variation range of the gradation data provided to the LCD panel, it is possible to improve the response speed of the STN-LCD effectively.

Moreover, although the present invention is limited to the STN-LCD in the aforementioned embodiment, the invention can be applied to other flat panel displays having response delay with respect to input signals in the same manner with the above described embodiment.

The forgoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

As described above, the present invention can provide a method and an apparatus for covering gradation data for an STN-LCD, capable of adequately converting moving picture data supplied to the STN-LCD to improve response characteristic of the STN-LCD.

Furthermore, the present invention can realize the data converting apparatus for an STN-LCD that can be easily designed and manufactured, and further, can meet various design specifications.

It will be apparent to those skilled in the art that various modifications and variations can be made in the method and apparatus for converting gradation data for STN LCD of the present invention without departing from the spirit or scope of the invention. Thus, it is intended that the present invention cover the modifications and variations of this invention provided they come within the scope of the appended claims and their equivalents.

What is claimed is:

1. A gradation data converting method for an STN-LCD comprising the steps of:

inputting gradation data for driving the STN-LCD;

comparing the input gradation data with previous gradation data corresponding to the input data, which was previously output through the same pixel of the STN-LCD, to calculate a difference between them;

converting the input gradation data based on the difference by multiplying the difference by a predetermined factor having a positive value larger than 1; and adding the multiplied result to the previous gradation data; and setting the gradation-converted data as new gradation data for driving the STN-LCD.

2. The gradation data converting method as claimed in claim 1, wherein the converting step, if the added result is larger than a maximum gradation value, the maximum gradation value is set as new gradation data, if the added result is smaller than a minimum gradation value, the minimum gradation value is set as new gradation data.

3. The gradation data converting method as claimed in claim 1, wherein the factor is variably set according to the difference.

4. A gradation data converting apparatus for an STN-LCD comprising:

an input data storing means for storing gradation data that is input for driving the STN-LCD;

a frame memory storing previous gradation data corresponding to the input data, which was previously output through the STN-LCD; and a data converting means for converting the input data based on the previous gradation data stored in the frame memory, and storing the converted data in the frame memory as new gradation data, wherein the data converting means subtracts the previous gradation data stored in the frame memory from the input data stored in the input data storing means, the input data and the previous gradation data being displayed through the same pixel of the STN-LCD, multiplies the subtracted result by a predetermined factor to generate a correction value, and adds the correction value to the previous gradation data, to generate new gradation data.

5. The gradation data converting apparatus as claimed in claim 4, wherein the factor is variably set according to the subtracted result.

6. A gradation data converting apparatus for an STN-LCD comprising:

a storage buffer for temporarily storing input gradation data;

a frame memory for storing previous gradation data corresponding to the input data, which was previously output through the STN-LCD;

a first address generator for generating a first address data for the frame memory, corresponding to a current display position;

a second address generator for generating a second address data for the frame memory of the gradation data stored in the storage buffer;

a gradation operating means for generating predetermined gradation data based on the gradation data stored in the storage buffer and previous gradation data output from the frame memory according to the second address data, and storing the generated gradation data in a second address region of the frame memory , wherein the gradation operating means subtracts the gradation data stored in the frame memory from the gradation data stored in the storage buffer, both gradation data being displayed through the same pixel of the STN-LCD, multiplies the subtracted result by a predetermined factor to generate a correction value, and adds the correction value to previous gradation data to generate new gradation data;

a gradation driving data generator for generating and outputting gradation driving data for the STN-LCD based on the gradation data stored in the frame memory; and a sequence controller for sequentially controlling the generation of the gradation driving data, performed by the gradation driving data generator, and the gradation operating process carried out by the gradation operating means.

7. The gradation data converting apparatus as claimed in claim 6, wherein the factor is larger than 1.

8. The gradation data converting apparatus as claimed in claim 6, wherein the factor is variably set.

* * * * *